US005474035A

United States Patent [19]

Ming et al.

[11] Patent Number: 5,474,035

[45] Date of Patent: Dec. 12, 1995

[54] ENGINE BREATHER CONSTRUCTION

[75] Inventors: Lam H. Ming; Chu K. Ying, both of Hong Kong, Hong Kong

[73] Assignee: Outboard Marine Corporation, Waukegan, Ill.

[21] Appl. No.: 375,268

[22] Filed: Jan. 19, 1995

Related U.S. Application Data

[63] Continuation of Ser. No. 273,017, Jul. 8, 1994, abandoned.

[51] Int. Cl.[6] ..... F01M 13/00

[52] U.S. Cl. ..... 123/41.86; 123/90.38

[58] Field of Search ..... 123/90.38, 41.86, 123/573, 574, 572

[56] References Cited

U.S. PATENT DOCUMENTS

| | | | |
|---|---|---|---|
| 3,960,132 | 6/1976 | Goserud | 123/196 CP |
| 4,179,246 | 12/1979 | Volker | 417/313 |
| 4,295,457 | 10/1981 | Schleicermacher | 123/574 |
| 4,528,969 | 7/1985 | Senga | 123/572 |
| 4,569,323 | 2/1986 | Okumura | 123/572 |
| 4,597,372 | 7/1986 | Furukawa | 123/572 |
| 4,601,267 | 7/1986 | Kronich | 123/90.33 |
| 4,602,595 | 7/1986 | Aoki et al. | 123/41.86 |
| 4,602,607 | 7/1986 | Balsley | 123/574 |
| 4,688,529 | 8/1987 | Mitadera et al. | 123/196 R |
| 4,721,090 | 1/1988 | Kato | 123/572 |
| 4,723,529 | 2/1988 | Yokoi et al. | 123/573 |
| 4,727,834 | 3/1988 | Isaka et al. | 123/196 W |
| 4,766,859 | 8/1988 | Miyaki et al. | 123/196 W |
| 4,790,287 | 12/1988 | Sakurai et al. | 123/573 |
| 4,926,814 | 6/1990 | Bonde | 123/196 W |
| 4,969,422 | 11/1990 | Ishikawa et al. | 123/41.86 |
| 4,993,375 | 2/1991 | Akihiko | 123/90.38 |
| 5,063,882 | 11/1991 | Koch et al. | 123/41.86 |
| 5,323,745 | 6/1994 | Sato et al. | 123/90.38 |

*Primary Examiner*—Noah P. Kamen

*Attorney, Agent, or Firm*—Michael, Best & Friedrich

[57] ABSTRACT

Disclosed herein is a four stroke engine breather comprising a camcase cover including an outer surface partially defining a camcase cover chamber including first and second sub-chambers communicating with each other and a sump sub-chamber, an inlet passage through the camcase cover and communicating with the camcase cover chamber for conveying an air/oil mist from the camcase to the camcase cover chamber, a restricted oil drainage passage through the camcase cover and communicating with the sump sub-chamber for conveying oil from the sump sub-chamber to the camcase, an oil drainage aperture in the camcase cover and communicating between the sump sub-chamber and one of the first and second sub-chambers, a plate engaging the camcase cover to further define the camcase cover chamber and including an aperture communicating through the plate with one of the first and second sub-chamber in the camcase cover chamber, a reed valve fixed relative to the plate and including a valve portion movable between positions closing and opening the aperture and being biased toward the closing position, and a breather cover including a wall engaging the plate to define therebetween a breather cover chamber which includes a series of serially connected sub-chambers including a first sub-chamber communicating, when the valve is in the opening position, through the aperture in the plate with the last mentioned one sub-chamber in the camcase cover chamber, and a last sub-chamber communicating with the atmosphere through an opening in the breather cover wall.

13 Claims, 2 Drawing Sheets

ENGINE BREATHER CONSTRUCTION

This is a continuation of application Ser. No. 273,017, filed Jul. 8, 1994, now abandoned.

BACKGROUND OF THE INVENTION

The invention relates generally to four stroke internal combustion engines and to breathers associated with the crankcases and camcases thereof.

Attention is directed to the following U.S. Patents.

| U.S. Pat. No. | Inventor(s) | Issue Date |
|---|---|---|
| 3,960,132 | Goserud | June 1, 1976 |
| 4,179,246 | Volker | December 18, 1979 |
| 4,295,457 | Schleicermacher | October 20, 1981 |
| 4,528,969 | Senga | July 16, 1985 |
| 4,569,323 | Okumura | February 11, 1986 |
| 4,597,372 | Furukawa | July 1, 1986 |
| 4,601,267 | Kronich | July 22, 1986 |
| 4,602,595 | Aoki, et al. | July 29, 1986 |
| 4,602,607 | Balsley | July 29, 1986 |
| 4,688,529 | Mitadera, et al. | August 25, 1987 |
| 4,721,090 | Kato | January 26, 1988 |
| 4,723,529 | Yokoi, et al. | February 9, 1988 |
| 4,727,834 | Isaka, et al. | March 1, 1988 |
| 4,766,859 | Miyaki, et al. | August 30, 1988 |
| 4,790,287 | Sakurai, et al. | December 13, 1988 |
| 4,926,814 | Bonde | May 22, 1990 |
| 4,969,422 | Ishikawa, et al. | November 13, 1990 |
| 5,063,882 | Koch, et al. | Novembert 12, 1991 |

SUMMARY OF THE INVENTION

The invention provides a four stroke engine breather comprising a camcase cover including an outer surface partially defining a camcase cover chamber including first and second sub-chambers communicating with each other and a sump sub-chamber, an inlet passage through the camcase cover and communicating with the camcase cover chamber for conveying an air/oil mist from the camcase to the camcase cover chamber, a restricted oil drainage passage through the camcase cover and communicating with the sump sub-chamber for conveying oil from the sump sub-chamber to the camcase, an oil drainage aperture in the camcase cover and communicating between the sump sub-chamber and one of the first and second sub-chambers, a plate engaging the camcase cover to further define the camcase cover chamber and including an aperture communicating through the plate with one of the first and second sub-chambers in the camcase cover chamber, a reed valve fixed relative to the plate and including a valve portion movable between positions closing and opening the aperture and being biased toward the closing position, and a breather cover including a wall engaging the plate to define therebetween a breather cover chamber which includes a series of serially connected sub-chambers including a first sub-chamber communicating, when the valve is in the opening position, through the aperture in the plate with the last mentioned one sub-chamber in the camcase cover chamber, and a last sub-chamber communicating with the atmosphere through an opening in the breather cover wall.

The invention also provides a four stroke engine breather comprising a camcase cover including an inner surface, an outer surface including an endless upstanding peripheral wall defining a camcase cover chamber, a baffle dividing the camcase cover chamber into first and second sub-chambers communicating with each other, a passage extending between the inner surface and the first camcase cover sub-chamber for conveying an air/oil mist from the camcase to the camcase cover chamber, a partition having ends extending from the peripheral wall to partially define a sump sub-chamber within the camcase cover chamber, a restricted passage between the sump sub-chamber and the inner surface to afford drainage of oil from the sump sub-chamber to the camcase, and an oil drainage aperture located in the partition and communicating between the sump sub-chamber and the second sub-chamber, a wire mesh element in the sump sub-chamber, a plate engaging the upstanding peripheral wall of the camcase cover, the baffle, and the partition to further define the camcase cover chamber and including an aperture communicating through the plate with the second sub-chamber in the camcase cover chamber, a reed valve fixed relative to the plate and including a valve portion movable between positions closing and opening the aperture and being biased towards the closing position, and a breather cover including an end wall extending in generally parallel relation to the camcase cover, an endless peripheral wall extending in upstanding relation to the end wall and engaging the plate to define therebetween a breather cover chamber, a series of baffles extending in upstanding relation to the end wall and within the peripheral wall and engaging the plate to subdivide the breather cover chamber into a series of serially connected sub-chambers including a first sub-chamber communicating, when the valve is in the opening position, through the aperture in the plate with the second sub-chamber in the camcase cover chamber, and a last sub-chamber communicating with the atmosphere through an opening in one of the end wall and the peripheral wall of the breather cover.

The invention also provides an outboard motor comprising a cylinder head partially defining a camcase, a camcase cover further defining the camcase and including an inner surface, and an outer surface, and a breather including an endless peripheral wall extending from the outer surface of the camcase cover in upstanding relation thereto and defining a camcase cover chamber, a baffle dividing the camcase case chamber into first and second sub-chambers communicating with each other, and a partition having ends extending from the peripheral wall to partially define a sump sub-chamber within the camcase cover chamber, a passage extending between the inner surface and the first camcase cover sub-chamber for conveying an air/oil mist from the camcase to the camcase cover chamber, and a restricted passage between the sump sub-chamber and the inner surface to afford drainage of oil from the sump sub-chamber to the camcase, a wire mesh element in the sump sub-chamber, a plate engaging the upstanding peripheral wall, the baffle, and the partition to further define the camcase cover chamber and including an aperture communicating through the plate with the second sub-chamber, a breather cover including an end wall extending in generally parallel relation to the camcase cover, an endless peripheral wall extending in upstanding relation to the end wall and engaging the plate to define therebetween a breather cover chamber, and a series of baffles extending in upstanding relation to the end wall and engaging the plate and within the peripheral wall to subdivide the breather cover chamber into a series of serially connected sub-chambers including a first sub-chamber communicating, when the valve is in the opening position, through the aperture in the plate with the second sub-chamber in the camcase cover chamber, and a last sub-chamber communicating with the atmosphere through an opening in one of the end wall and the peripheral wall of the breather cover.

Other features and advantages of the invention will become apparent to those of ordinary skill in the art upon review of the following detailed description, claims, and drawings.

Figure 1:
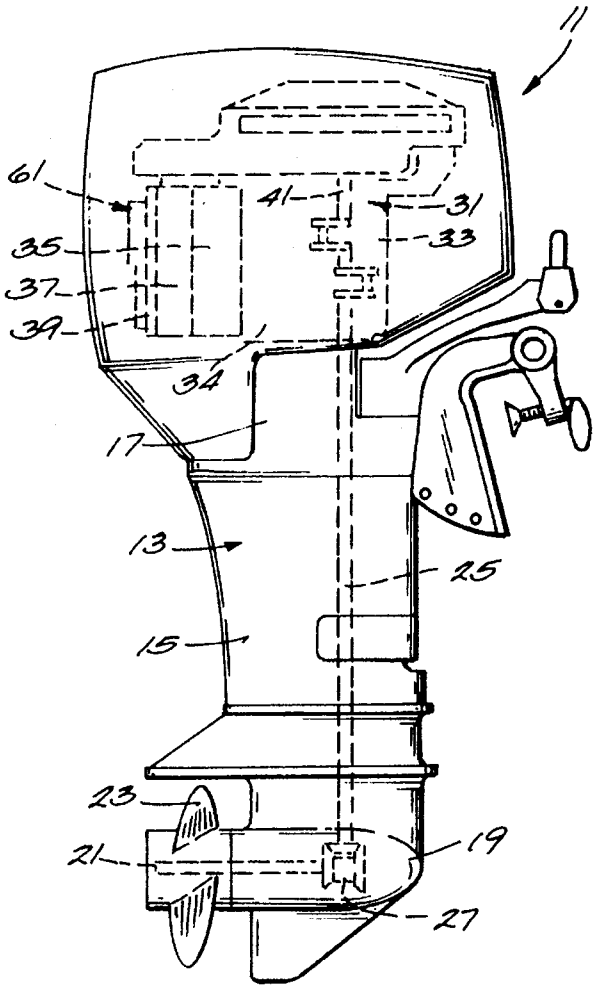
FIG. 1 is a side elevational view of an outboard motor embodying various of the features of the invention.
Figure 2:
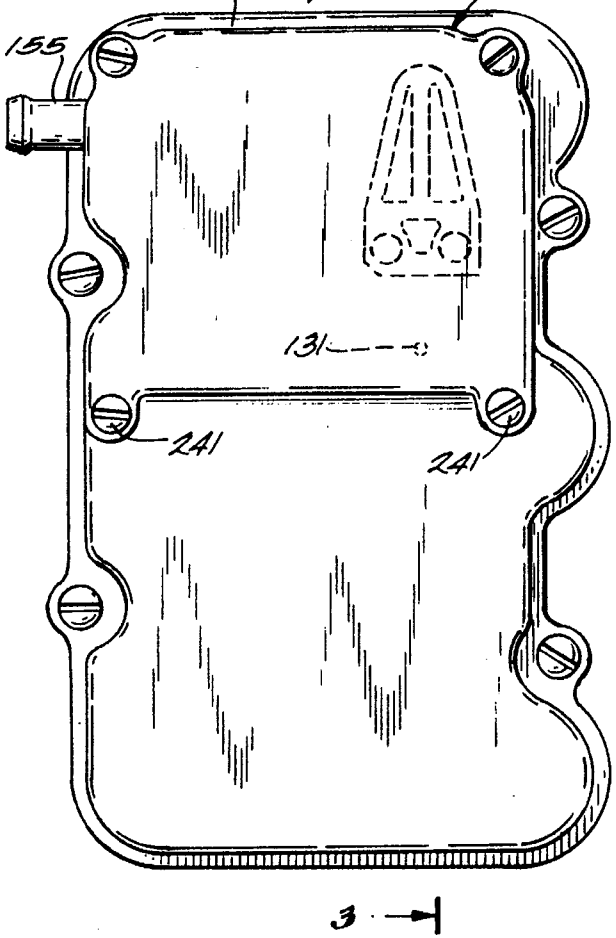
FIG. 2 is a view of certain of the component of an air/oil mist breather which is incorporated in the outboard motor shown in FIG. 1 and which includes various of the features of the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown in FIG. 1 of the drawings is an outboard motor 11 including a lower unit 13 comprising a driveshaft housing 15 having an upper end to which a powerhead assembly 17 is rigidly connected. The driveshaft housing 15 also includes a lower end to which is rigidly connected is a gearcase assembly 19 rotatably supporting a propeller shaft 21 carrying a propeller 23.

The lower unit 13 also includes a driveshaft 25 which is rotatably supported in the driveshaft housing 15 and which, at its lower end, is drivingly connected through a transmission 27 with the propeller shaft 21.

The powerhead assembly 17 includes an internal combustion engine comprising an engine block assembly 31 including a cylinder block 33 which defines a crankcase 34 and one or more cylinders (not shown) and to which is attached a cylinder head 35 which, in part, defines a camcase 37 closed by a camcase cover 39 fixed to the cylinder head 35.

Rotatably supported by the cylinder block 33 is a crankshaft 41 which extends through the crankcase 34 and which, at its lower end, is drivingly connected to the driveshaft 25.

As above described, the construction is conventional and any suitable arrangement can be employed.

Located on the upper half of the rear surface of the camcase cover 39 is a breather or breather assembly 61 which accommodates variation in pressure in the crankcase 34 and in the camcase 37, which, at least in part, separates the air and the oil carried in an air/oil mist in the camcase 37, which returns the separated oil to the camcase, and which supplies the separated air and whatever air/oil mist remains to the air induction passage (not shown) of the fuel feeding means.

Figure 3:
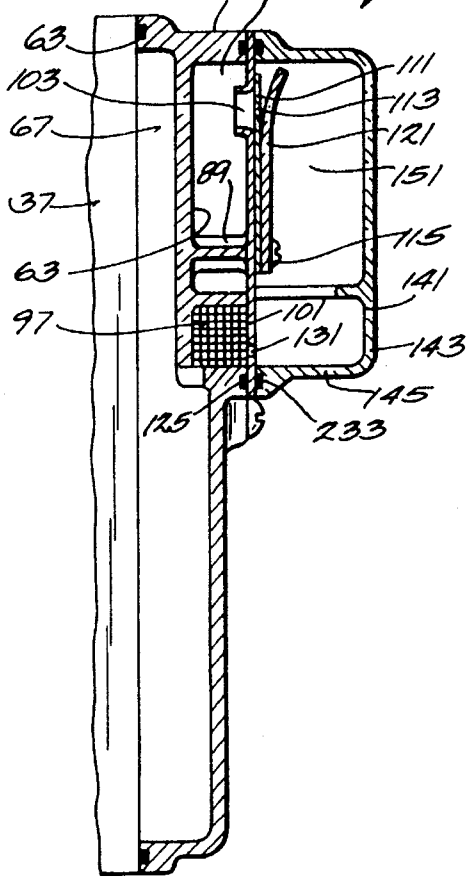
FIG. 3 is a fragmentary sectional view taken along Line 3—3 of FIG. 2 and including an additional component of the breather incorporated in the outboard motor shown in FIG. 1.

The breather 61 is defined, in part, see especially FIG. 3, by a rear surface 63 of the camcase cover 39 and by an endless peripheral wall 65 extending in upstanding relation to and rearwardly from the camcase cover 39, whereby to define, in part, a camcase cover breather chamber or cavity 67.

The camcase cover 39 also includes, as part of the breather 61, a baffle or wall 71 extending in upstanding relation from the rear surface 63 of the camcase cover 39 and from one part of the peripheral wall 65 so as to divide the camcase cover chamber 67 into first and second or left and right sub-chambers 73 and 75 which are in communication with each other. More particularly, as seen in FIG. 4, the partition baffle 71 extends downwardly from the top side wall portion 79 of the endless peripheral wall 65, in spaced generally parallel relation to the left wall portion 80 of the peripheral wall 65 and terminates, at the left, in spaced relation to the lower or bottom side wall portion 82 of the peripheral wall 65.

Figures 4, 5, 6, 7, 8, 9, 10:
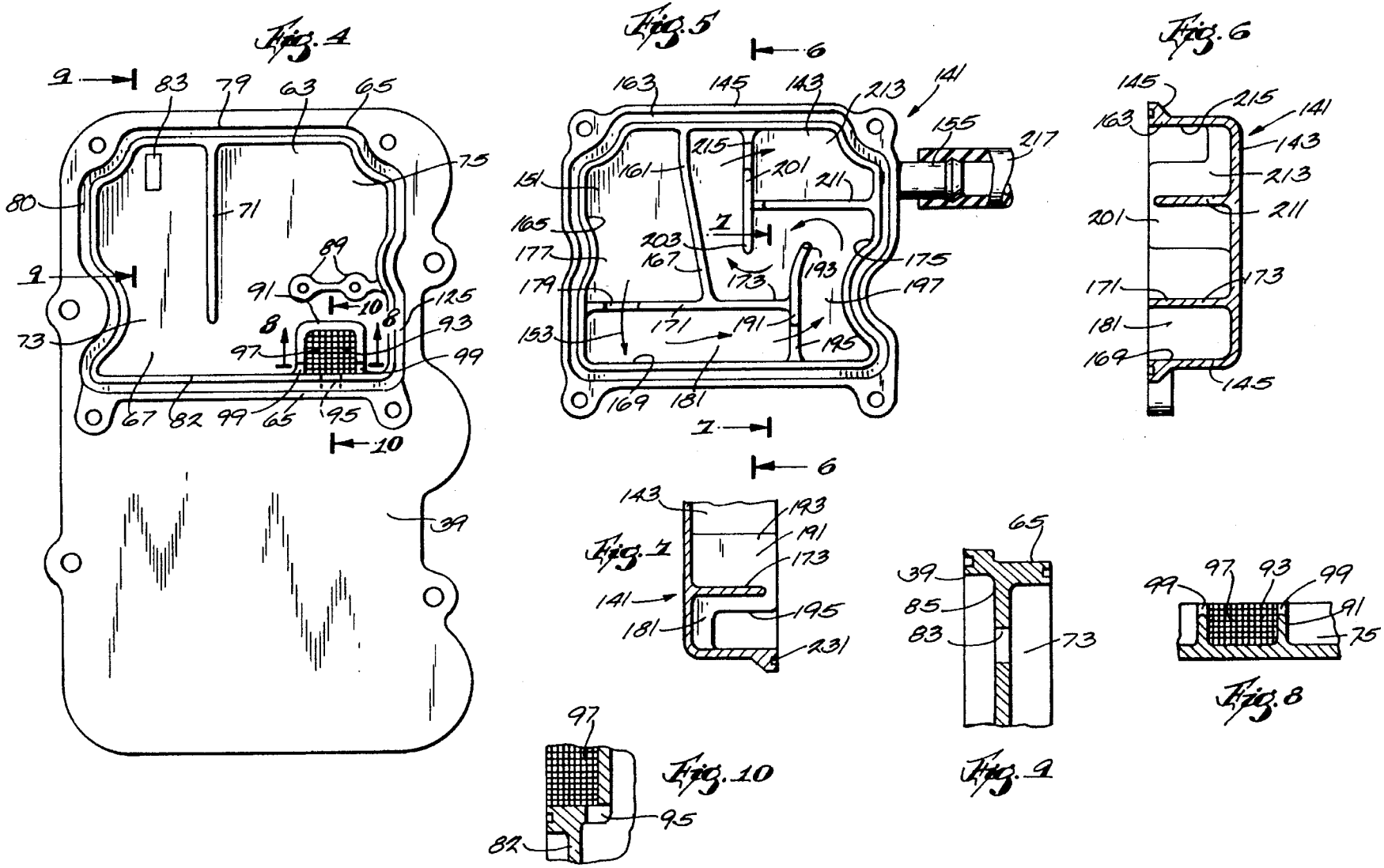
FIG. 4 is a rear-view of a camcase cover which forms part of the breather included in the outboard motor shown in FIG. 1.
FIG. 5 is a front-view of a breather cover which is included in the breather incorporated in the outboard motor shown in FIG. 1.
FIG. 6 is a sectional view taken along line 6—6 of FIG. 1.
FIG. 7 is a fragmentary sectional view taken along line 7—7 of FIG. 5.
FIG. 8 is a fragmentary sectional view taken along line 8—8 of FIG. 4.
FIG. 9 is a fragmentary sectional view taken along line 9—9 of FIG. 4.
FIG. 10 is a fragmentary sectional view taken along line 10—10 of FIG. 4.

The camcase cover 39 also includes, as seen in FIG. 4, in the upper left hand area of the upper sub-chamber 73, a vent passage 83 extending between the outer of rearwardly facing surface 63 and the inner or forwardly facing surface 85 of the camcase cover 39, thereby providing for flow of air/oil mist from the camcase 37 into the left sub-chamber 73 of the camcase cover chamber 67 of the breather 61.

Also included in the camcase cover cavity or chamber 67 are a pair of bosses 89 which extend in the right sub-chamber 75 in rearwardly upstanding relation from the rear surface 63 of the camcase cover 39 and which include respective outer rearward ends which respectively include threaded apertures which will be referred to hereinafter.

The camcase cover chamber 67 also includes, as seen in FIG. 4, adjacent the bottom side wall portion 82 of the periferal wall 65, a partition or wall 91 which extends rearwardly in upstanding relation to the rear surface 63, and which, at its ends, extends from spaced parts of the bottom side wall portion 82 of the peripheral wall 65 to at least partially define a sub-chamber 93 which serves as an oil sump.

Communicating through the camcase cover 39 at a low-point in the sump sub-chamber 93 is a restricted or relatively small passage or port 95 affording return flow or drainage of oil from the sump sub-chamber 93 to the camcase 37. As shown in FIG. 10, the passage or port 95 is located in the lower wall portion 82 of the peripheral wall 65.

Substantially occupying the volume of the oil sump sub-chamber 93 is a body of wire mesh or wire mesh element 97 which serves to prevent flow of air/oil mist from the camcase 37 into the oil sump sub-chamber 93 through the oil drainage passage 95.

Communicating between and the sump sub-chamber 93 and the right sub-chamber 75 are small or restricted oil flow passages 99 formed by small portions of the partition 91 which are located immediately adjacent the lower or bottom wall portion 82 of the periferal wall 65 and which are of reduced height as compared to the remainder of the partition 91.

Closing the camcase cover chamber 67, including the sump sub-chamber 93, is a plate 101 which is preferably fabricated of metal, which engages the rearward edges of the upstanding peripheral wall 65, of the baffle 71 and of the partition 91 to complete definition of the upper and lower sub-chambers 73 and 75 and of the sump sub-chamber 93. The plate 101 also includes an opening or aperture 103 which communicates with a central portion of the right half of the upper sub-chamber 73 of the camcase cover chamber 67.

The breather 61 also includes a leaf spring 111 which is located adjacent the rearward surface of the plate 101, which includes a valve portion 113 overlaying the aperture 103 in the plate 101, and which is fixed in place by a pair of screws 115 which pass through suitable openings in the leaf spring 111 and in the plate 101 and which are threaded into the threaded aperture in the previously described bosses 89 in the camcase cover chamber 67.

Preferably, a leaf spring guide or stop 121 is also fixed by the screws 115 in overlaying relation to the leaf spring 111 to limit leaf spring movement away from the closed position.

In order to prevent leakage of air/oil mist from between the plate 101 and the upstanding peripheral wall 65 of the camcase cover 39, the peripheral wall 65 includes an annular groove 125 which receives an endless gasket bearing between the peripheral wall 65 and the plate 101.

The plate 101 also includes a small or restricted drainage opening or aperature 131 which communicates with the sump sub-chamber 93 and which affords flow or drainage of liquid oil to the sump sub-chamber 93 from the outer or breather cover chamber which will now be described.

The breather 61 also includes a breather cover 141 which include a rear wall 143 extending in generally parallel relation to the camcase cover 37, and an endless peripheral wall 145 extending forwardly from the rear wall in upstanding relation thereto and which has a contour generally corresponding to the contour of the peripheral wall 65 of the camcase cover 39. The breather cover 141, together with the plate 101, defines a breather cover chamber 151.

The breather cover 141 also includes within the breather cover chamber 151 a series of partitions which extend forwardly in upstanding relation from the rear wall 143 and which engage the plate 101 to sub-divide the breather cover cavity 151 into several sub-chambers which provide a serpentine flow path or labyrinth 153 extending from the aperture 103 in the plate 101 to an outlet nipple 155 extending outwardly from a side portion of the upstanding peripheral wall 145 of the breather cover 144.

More specifically, while other constructions can be employed, in the disclosed construction, the breather cover 141 also includes, as shown in FIG. 5, a first partition or baffle wall 161 which extends downwardly from the left part of an upper wall portion 163 of the endless peripheral wall 145 of the breather cover 141, which extends in generally parallel relation to a left side wall portion 165 of the endless peripheral wall 145, and which includes a lower end 167 terminating in spaced relation to a lower wall portion 169 of the peripheral wall 145.

The breather cover 141 also includes, as generally shown in FIG. 5, a second partition 171 which extends from the left side wall portion 165 of the peripheral wall 145, and in generally parallel spaced relation to the lower wall portion 169 of the peripheral wall 145, which extends integrally with the lower end 167 of the first partition 161, and which extends to the right of the first partition and has an outer end terminating in spaced relation to a right side wall portion 175 of the peripheral wall 145.

The first and second partitions 161 and 171 define a first sub-chamber 177 which is closed except for the aperture 103 in the plate 101 and for a small area which is located in the second partition 171, which is adjacent to the left side wall portion 165, which is of less than full height, and which provides a passage 179 affording flow of the air/oil mist to a second sub-chamber 181 located below the second partition 171 and between the second partition 171 and the lower wall portion 169 of the peripheral wall 145.

The breather cover 141 also includes, as shown in FIG. 5, a third partition or baffle wall 191 which extends from the right part of the lower wall portion 169 of the peripheral wall 145, and to the outer end 173 of the second partition 171, to thereby complete definition of the second sub-chamber 181 below the second partition 171 and to the left of the third partition 191. The third partition 191 also extends above the second partition 171 and includes an upper end 193.

Adjacent the lower wall portion 169 of the peripheral wall 145, the third partition or wall 191 includes a portion of reduced height to provide a passageway 195 permitting flow of air/oil mist from the second sub-chamber 181 to a third sub-chamber 197, still to be described.

The breather cover 141 also includes a fourth partition or wall 201 which extends downwardly from the right part of the upper wall portion 163 of the peripheral wall 145 and between the right side wall portion 175 of the peripheral wall 145 and the first partition 161, and which has a lower end 203 located somewhat below the upper end 193 of the third partition 191.

In addition, the breather cover 141 includes a fifth partition or wall 211 which extends, as shown in FIG. 5, from a mid-part of the right side wall portion 175 of the peripheral wall 145, which joins the fourth partition 201 in upwardly spaced relation from the lower end 203 thereof, and which together with the fourth partition 201, defines the third sub-chamber 197 which extends between the third partition 191 and the right side wall portion 175 of the peripheral wall 145, below the fifth partition 211 and around the upper end 193 of the third partition 191, above the rightward part of the second partition 171 and around the lower end 203 of the fourth partition 201, and between the first and fourth partition 161 and 201. In addition, the fourth and fifth partitions 201 and 211 cooperate, as shown to the right in FIG. 5, with an upper part of the right side wall portion 175 of the peripheral wall and with the right part of the upper wall portion 163 of the peripheral wall 145 to define a fourth sub-chamber 213. The fifth partition 211 includes a portion of reduced height adjacent the upper portion 163 of the peripheral wall 145 to provide a passageway 215 affording flow of air/oil mist between the third and fourth sub-chambers 197 and 213.

The before mentioned outlet 155 is in the form of a nipple communicating with the fourth sub-chamber 213, as shown to the right in FIG. 5, through the upper part of the right side wall portion 175 of the peripheral wall. The outlet or nipple 155 is adapted to be connected to a flexible hose 217 leading to a carburetor air intake (not shown) so that any air/oil mist leaving the breather 61 is combusted.

In order to prevent leakage of air/oil mist between the breather cover 141 and the plate 101, the outer surface of the peripheral wall 145 of the breather cover 141 is provided with an endless groove or slot 231 receiving an endless gasket 233 bearing between the plate 101 and the breather cover 141.

Suitable bolts 241 extend through suitable lugs in the breather cover 141 and through suitable apertures in the breather plate 101 and are received in suitable threaded apertures adjacent the peripheral upstanding wall 65 in the camcase cover 39 so as to assemble together the breather cover 141, the plate 101, and the camcase cover to form a completed breather assembly 61.

Various of the features of the invention are set forth in the following claims.

We claim:

1. A four stroke engine breather comprising a camcase cover including an outer surface partially defining a camcase cover chamber including first and second sub-chambers communicating with each other and a sump sub-chamber, an inlet passage through said camcase cover and communicating with said camcase cover chamber for conveying an air/oil mist from the camcase to said camcase cover chamber, a restricted oil drainage passage through said camcase cover and communicating with said sump sub-chamber for conveying oil from said sump sub-chamber to the camcase, an oil drainage aperture in said camcase cover and communicating between said sump sub-chamber and one of said first and second sub-chambers, a plate engaging said camcase cover to further define said camcase cover chamber and including an aperture communicating through said plate with one of said first and second sub-chambers in said camcase cover chamber, a reed valve fixed relative to said plate and including a valve portion movable between positions closing and opening said aperture and being biased toward said closing position, and a breather cover including a wall engaging said plate to define therebetween a breather cover chamber which includes a series of serially connected sub-chambers including a first sub-chamber communicating, when said valve is in the opening position, through said aperture in said plate, with said last mentioned one sub-chamber in said camcase cover chamber, and a last sub-chamber communicating with the atmosphere through an opening in said breather cover wall.

2. A four stroke engine breather in accordance with claim 1 wherein said series of sub-chambers includes second and third sub-chambers, and wherein said first, second, third and last sub-chambers serially communicate with one other through restricted passages therebetween.

3. A four stroke engine breather in accordance with claim 1 wherein said sump sub-chamber includes therein a wire mesh element.

4. A four stroke engine breather in accordance with claim 1 wherein said plate includes a drainage aperature providing oil drainage from said breather cover chamber to said sump sub-chamber.

5. A four stroke engine breather comprising a camcase cover including an inner surface, an outer surface including an endless upstanding peripheral wall defining a camcase cover chamber, a baffle dividing said camcase cover chamber into first and second sub-chambers communicating with each other, a passage extending between said inner surface and said first camcase cover sub-chamber for conveying an air/oil mist from the camcase to said camcase cover chamber, a partition having ends extending from said peripheral wall to partially define a sump sub-chamber within said camcase cover chamber, a restricted passage between said sump sub-chamber and said inner surface to afford drainage of oil from said sump sub-chamber to the camcase, and an oil drainage aperture located in said partition and communicating between said sump sub-chamber and said second sub-chamber, a wire mesh element in said sump sub-chamber, a plate engaging said upstanding peripheral wall of said camcase cover, said baffle, and said partition to further define said camcase cover chamber and including an aperture communicating through said plate with said second sub-chamber in said camcase cover chamber, a reed valve fixed relative to said plate and including a valve portion movable between positions closing and opening said aperture and being biased towards said closing position, and a breather cover including an end wall extending in generally parallel relation to said camcase cover, an endless peripheral wall extending in upstanding relation to said end wall and engaging said plate to define therebetween a breather cover chamber, a series of baffles extending in upstanding relation to said end wall and within said peripheral wall and engaging said plate to subdivide said breather cover chamber into a series of serially connected sub-chambers including a first sub-chamber communicating, when said valve is in the opening position, through said aperture in said plate with said second sub-chamber in said camcase cover chamber, and a last sub-chamber communicating with the atmosphere through an opening in one of said end wall and said peripheral wall of said breather cover.

6. A four stroke engine breather in accordance with claim 5 wherein said peripheral wall of said breather cover includes an upper wall portion, a lower wall portion, a left side wall portion extending from said upper and lower wall portions, and a right side wall portion extending from said upper and lower wall portions, and wherein said series of baffles includes a first baffle extending downwardly from said upper wall portion in spaced relation to one of said side wall portions and including a lower end spaced from said lower wall portion, a second baffle extending laterally from said one side wall portion in spaced relation to said lower wall portion and to said lower end of said first baffle to define said first sub-chamber and to an outer end spaced from the other of said side wall portions, a third baffle extending upwardly from said lower wall portion and in spaced relation to said other side wall portion and to said outer end of said second baffle to define a second sub-chamber and to an upper end in spaced relation below said upper wall portion, a fourth baffle extending laterally from said other side wall portion in spaced relation from said upper wall portion and said upper end of said third baffle and having an outer end spaced laterally from said first baffle, a fifth baffle extending downwardly from said upper wall portion in spaced relation from said first baffle and said other side wall portion and to said outer end of said fourth baffle to define, with said upper wall portion, with said other side wall portion, and with said fourth baffle, said last sub-chamber, and to an outer end in spaced relation above said second baffle to define, with said first, second, third and fourth baffles, a serpentine third sub-chamber.

7. A four stroke engine breather in accordance with claim 6 wherein said first sub-chamber communicates with said second sub-chamber through an opening in said second baffle, wherein said second sub-chamber communicates with said third sub-chamber through an opening in said third baffle, and wherein said third sub-chamber and said last sub-chamber communicate through an opening in said fifth baffle.

8. A four stroke engine breather in accordance with claim 5 wherein said plate includes a drainage aperature providing oil drainage from said breather cover chamber to said sump sub-chamber.

9. An outboard motor comprising a cylinder head partially defining a camcase, a camcase cover further defining said camcase and including an inner surface, and an outer surface, and a breather including an endless peripheral wall extending from said outer surface of a said camcase cover in upstanding relation thereto and defining a camcase cover chamber, a baffle dividing said camcase case chamber into first and second sub-chambers communicating with each other, and a partition having ends extending from said peripheral wall to partially define a sump sub-chamber within said camcase cover chamber, a passage extending between said inner surface and said first camcase cover sub-chamber for conveying an air/oil mist from said camcase to said camcase cover chamber, and a restricted passage between said sump sub-chamber and said inner surface to afford drainage of oil from said sump sub-chamber to the camcase, a wire mesh element in said sump sub-chamber, a plate engaging said upstanding peripheral wall, said baffle, and said partition to further define said camcase cover chamber and including an aperture communicating through said plate with said second sub-chamber, a reed valve fixed relative to said plate and including a valve portion movable between positions closing and opening said aperture and being biased toward said closing position, and a breather cover including an end wall extending in generally parallel relation to said camcase cover, an endless peripheral wall extending in upstanding relation to said end wall and engaging said plate to define therebetween a breather cover chamber, and a series of baffles extending in upstanding relation to said end wall and engaging said plate and within said peripheral wall to subdivide said breather cover chamber into a series of serially connected sub-chambers including a first sub-chamber communicating, when said valve is in the opening position, through said aperture in said plate with said second sub-chamber in said camcase cover chamber, and a last sub-chamber communicating with the atmosphere through an opening in one of said end wall and said peripheral wall of said breather cover.

10. A four stroke engine breather in accordance with claim 9 wherein said peripheral wall of said breather cover includes an upper wall portion, a lower wall portion, a left side wall portion extending from said upper and lower wall portions, and a right side wall portion extending from said upper and lower wall portions, and wherein said series of baffles includes a first baffle extending downwardly from said upper wall portion in spaced relation to one of said side wall portions and including a lower end spaced from said lower wall portion, a second baffle extending laterally from said one side wall portion in spaced relation to said lower wall portion and to said lower end of said first baffle to define said first sub-chamber and to an outer end spaced from the other of said side wall portions, a third baffle extending upwardly from said lower wall portion and in spaced relation to said other side wall portion and to said outer end of said second baffle to define a second sub-chamber and to an upper end in spaced relation below said upper wall portion, a fourth baffle extending laterally from said other side wall portion in spaced relation from said upper wall portion and said upper end of said third baffle and having an outer end spaced laterally from said first baffle, a fifth baffle extending downwardly from said upper wall portion in spaced relation from said first baffle and said other side wall portion and to said outer end of said fourth baffle to define, with said upper wall portion, with said other side wall portion, and with said fourth baffle, said last sub-chamber, and to an outer end in spaced relation above said second baffle to define, with said first, second, third and fourth baffles, a serpentine third sub-chamber.

11. A four stroke engine breather in accordance with claim 10 wherein said first sub-chamber communicates with said second sub-chamber through an opening in said second baffle, wherein said second sub-chamber communicates with said third sub-chamber through an opening in said third baffle, and wherein said third sub-chamber and said last sub-chamber communicate through an opening in said fifth baffle.

12. A four stroke engine breather in accordance with claim 9 wherein said plate includes a drainage aperature providing oil drainage from said breather cover chamber to said sump sub-chamber.

13. A four stroke engine breather comprising a camcase cover including an outer surface partially defining a camcase cover chamber including a first sub-chamber and a sump sub-chamber, an inlet passage through said camcase cover and communicating with said camcase cover chamber for conveying an air/oil mist from the camcase to said camcase cover chamber, a restricted oil drainage passage through said camcase cover and communicating with said sump sub-chamber for conveying oil from said sump sub-chamber to the camcase, an oil drainage aperture in said camcase cover and communicating between said sump sub-chamber and said first sub-chamber in said camcase cover chamber, a plate engaging said camcase cover to further define said camcase cover chamber and including an aperture communicating through said plate with said first sub-chamber in said camcase cover chamber, a reed valve fixed relative to said plate and including a valve portion movable between positions closing and opening said aperture and being biased toward said closing position, and a breather cover including a wall engaging said plate to define therebetween a breather cover chamber which includes a series of serially connected sub-chambers including a first sub-chamber communicating, when said valve is in the opening position, through said aperture in said plate, with said first sub-chamber in said camcase cover chamber, and a last sub-chamber communicating with the atmosphere through an opening in said breather cover wall.

* * * * *